United States Patent [19]

Takatsuka et al.

[11] Patent Number: 4,811,947

[45] Date of Patent: Mar. 14, 1989

[54] VIBRATION ABSORBER FOR A RACKET

[75] Inventors: Masanori Takatsuka; Yoshinori Hariguchi, both of Shizuoka, Japan

[73] Assignee: Yamaha Corporation, Japan

[21] Appl. No.: 15,941

[22] Filed: Feb. 18, 1987

[30] Foreign Application Priority Data

Feb. 19, 1986 [JP] Japan ..... 61-034180
Feb. 19, 1986 [JP] Japan ..... 61-034181

[51] Int. Cl.[4] ..... A63B 49/08

[52] U.S. Cl. ..... 273/73 J; 267/141; 273/73 G

[58] Field of Search ..... 273/73 J, 73 R, 73 G, 273/73 C, 67 R; 84/22; 267/141, 153; 74/574, 551.8, 551.9, 551.2, 551.1; 124/89; 248/559

[56] References Cited

U.S. PATENT DOCUMENTS 3,891,191 6/1975 Choules et al. ..... 248/559
4,406,344 9/1983 Fukushima ..... 267/141
4,600,194 7/1986 Donnelly ..... 273/73 G
4,660,832 4/1987 Shomo ..... 273/73 J

FOREIGN PATENT DOCUMENTS 4413 10/1926 Australia ..... 74/551.2
2547506 12/1984 France ..... 273/73 J

*Primary Examiner*—Richard C. Pinkham
*Assistant Examiner*—William E. Stoll
*Attorney, Agent, or Firm*—Lerner, David, Littenberg, Krumholz & Mentlik

[57] ABSTRACT

In construction of a vibration absorber for a racket, a mass is indirectly supported by a visco-elastic member arranged within the grip or the yoke of the racket via an elongated interface so that resonant swing of the interface on receipt of vibration from the head of the racket should cause deformation of the visco-elastic member for thermal diffusion of vibration energy. The visco-elastic member is sandwiched between two elongated leaf springs. One end of the leaf spring is mounted to the wall of the racket handle and the other end of the leaf spring supports the mass. By proper choice of the component, vibration in a specified frequency range can be selectively damped so as to match vibration characteristics of rackets of various types.

3 Claims, 4 Drawing Sheets

VIBRATION ABSORBER FOR A RACKET

BACKGROUND OF THE INVENTION

The present invention relates to an improved vibration absorber for a racket, and more particularly relates to improvement in vibration absorbing function of a racket such as a tennis racket.

In this specification including claims, the term "straight end section" refers to the grip or yoke of a racket.

In one conventional proposal, a vibration absorber includes a simple pendulum made of viscous material and externally attached to the body of a racket frame in order to damp vibration generated as striking balls. With this construction, however, it is very difficult to match the function of the absorber to the vibration characteristics of the racket.

SUMMARY OF THE INVENTION

It is the object of the present invention to provide a vibration absorber well suited for any types of racket with optimum vibration damping.

In accordance with the basic aspect of the present invention, a visco-elastic member is securedly arranged within the straight end section of a racket and a mass is indirectly supported by the elastic member via an interface.

DESCRIPTION OF THE PREFERRED EMBODIMENT

Figure 1:
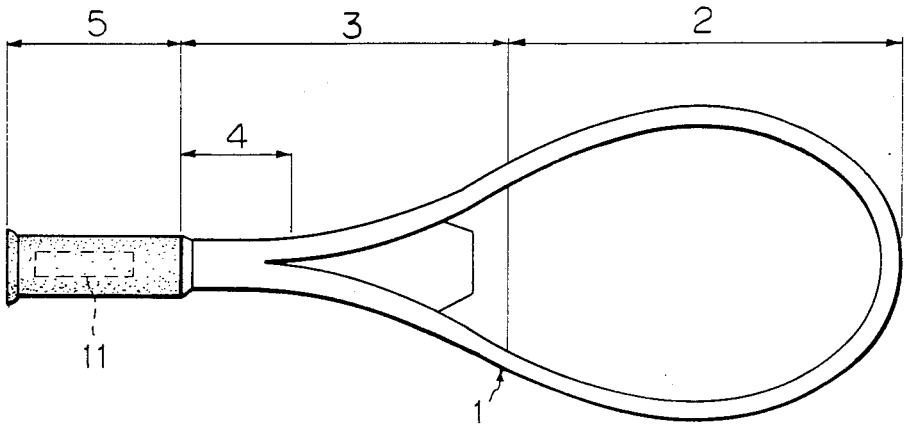
FIG. 1 is a plan view of a tennis racket incorporating the vibration absorber in accordance with the present invention.

FIG. 1 shows the general construction of a tennis racket. The tennis racket 1 includes an oval head 2, a grip 5 and a yoke 3 including a shaft 4 and the vibration absorber 11 in accordance with the present invention is arranged within the grip 5 as shown with dot lines or in the yoke 3.

Figure 2:
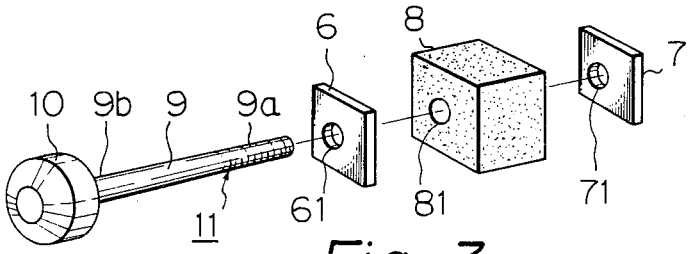
FIG. 2 is a perspective view of one embodiment of the vibration absorber in accordance with the present invention in a disassembled state.
Figure 3:
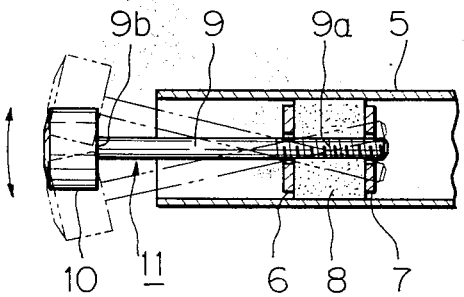
FIG. 3 is a side view, partly in section, of the vibration absorber shown in FIG. 2 in the assembled state.

One embodiment of the vibration absorber in accordance with the present invention is shown in FIGS. 2 and 3. As best seen in FIG. 2, the vibration absorber 11 includes a visco-elastic member 8 made of low repulsion rubber, a pair of holder plates 6 and 7 having threaded holes 61 and 71, a fastener rod 9 having a partial thread **9*a*, and a mass 10 attached to the free end 9*b* of the fastener rod 9. The visco-elastic member 8 has a through hole 81 large enough to freely pass the fastener rod 9**.

In order to assemble the vibration absorber 11, the pair of holder plates 6 and 7 are attached to the visco-elastic member 8 in a manner to sandwich the latter. Next, the partial thread **9*a* of the fastener rod 9 is screwed into the threaded holes 61 and 71 of the holder plate 9 past the visco-elastic member 8 so that the holder plates 6 and 7 clamp the visco-elastic member 8. Then the assembled combination is inserted into the grip 5 of the tennis racket 1 and the fastener rod 9 is further axially rotated in order to cause compressive deformation of the visco-elastic member 8. This compressive deformation places the visco-elastic member 8 in pressure contact with the inner wall of the grip 5, thereby securedly mounting the entire vibration absorber 11 to the interior of grip 5**.

Figure 6:
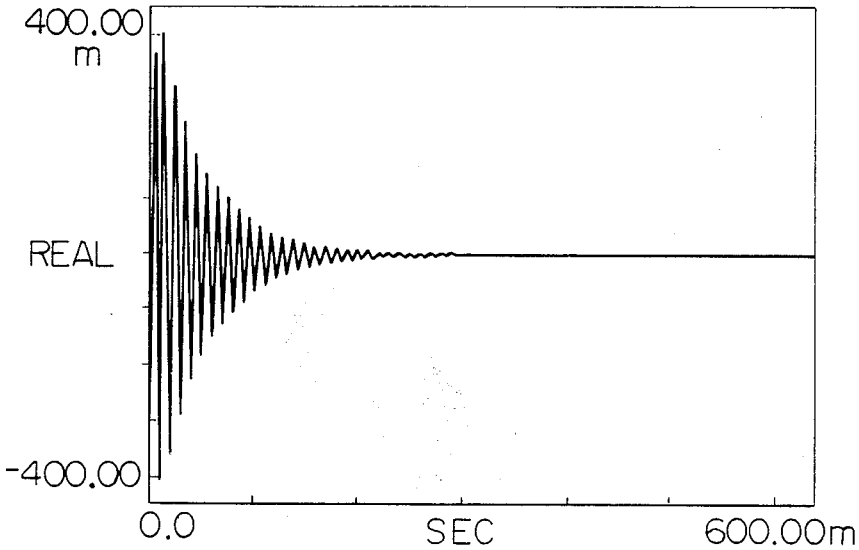
FIGS. 6 is a graph for showing the state of vibration damping when the present invention is employed.
Figure 9:
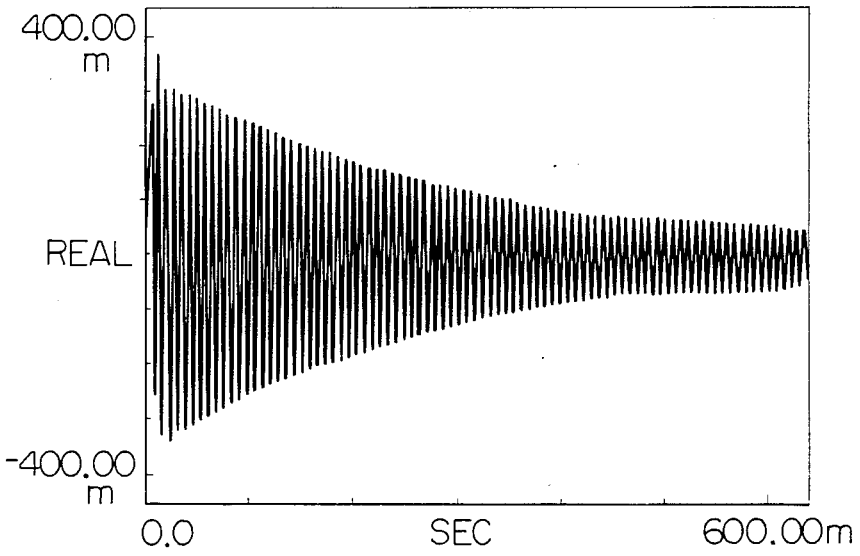
FIG. 9 is a graph for showing the state of vibration damping when the present invention is not employed.

When vibration is generated on the head 2 at striking balls, the fastener rod 9 swings in consonance with the transmitted vibration as shown with chain lines to cause corresponding compressive and shearing deformation and, as a consequence, thermal diffusion of vibration energy. As a result, the vibration is promptly damped as shown in FIG. 6. When this mode of vibration damping is compared with that shown in FIG. 9 in which no vibration absorber is used, the merit of the present invention will be well recognized.

Figure 7:
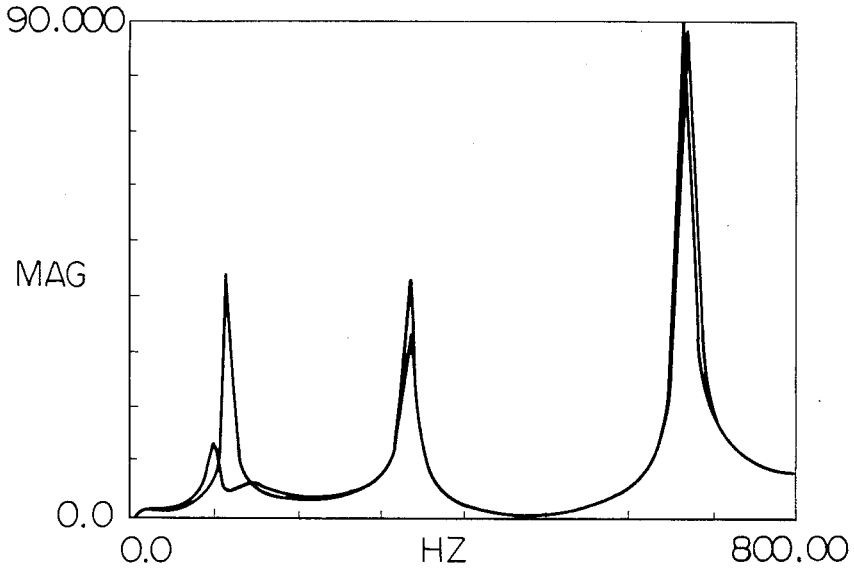
FIGS. 7 and 8 are graphs for showing vibration damping characteristics of the primary and secondary modes of vibrations when the present invention is employed.
Figure 8:
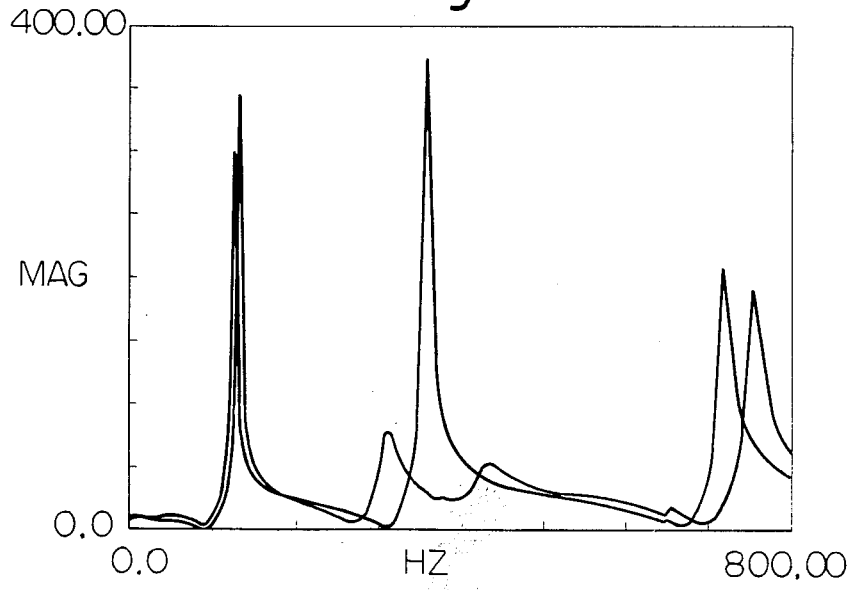

The modes of vibration damping in accordance with the present invention are shown in FIGS. 7 and 8 also, in which the frequency of vibration is taken on the abscissa and the amplitude of vibration is taken on the ordinate. The notation "MAG" appearing on the drawings stands for magnitude and is expressed in the units $mV^2$. In the case of FIG. 7 only the primary vibration is damped and only the secondary vibration is damped in FIG. 8. It is clear that vibration in a specified frequency range can be selectively damped by properly adjusting the length of the fastener rod 9, the weight of the mass 10 and/or the hardness, i.e. the viscosity, of the visco-elastic member 8. Needless to say, the vibration absorber 11 may be arranged within the yoke 3 too. By properly adjusting the length of the fastener rod 9, the vibration absorber 11 can function as a sort of weight balancer, too.

In order to disassemble the vibration absorber 11, it is only required to axially rotate the fastener rod 9 reversely. Thus, mounting and dismounting of the vibration absorber can be carried out by very simple manual operation.

Figure 4:
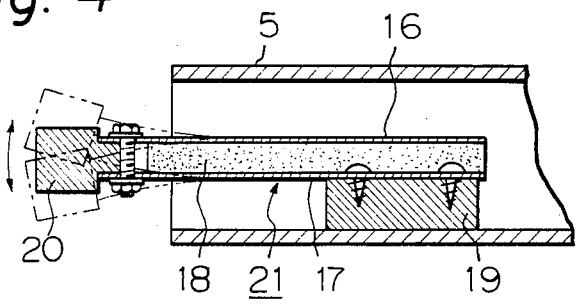
FIGS. 4 and 5 are side sectional and perspective views of the other embodiment of the vibration absorber in accordance with the present invention.
Figure 5:
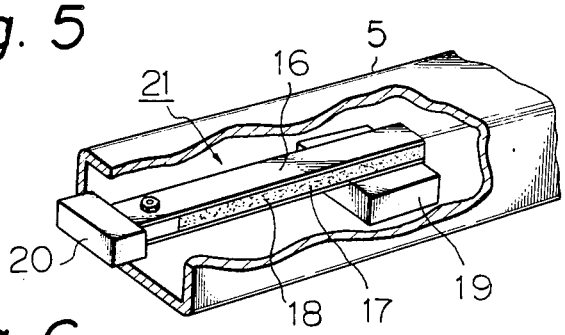

The other embodiment of the vibration absorber in accordance with the present invention is shown in FIGS. 4 and 5, in which the vibration absorber 21 includes a visco-elastic member 18 made of high viscosity rubber, a pair of leaf springs 16 and 17 sandwiching the visco-elastic member 18 and a mass 20 attached to the free ends of the leaf springs 16 and 17 by means of a bolt-nut combination. The other ends of the leaf spring 16 and 17 are supported by a seat 19 secured to the inner wall of the grip 5.

As vibration is generated on the head 2, the leaf springs 16 and 17 swing resonantly as shown with chain lines in FIG. 4 like the fastener rod 9 in FIG. 3 and shearing deformation of the visco-elastic member 18 is caused for thermal diffusion of vibration energy, thereby greatly damping vibration. As in the foregoing embodiment, vibration in a specified frequency range can be selectively damped by proper choice of the length of the leaf springs 16 and 18, the weight of the mass 20 and/or the hardness, i.e. the viscosity of the visco-elastic member 18.

Since vibration in a specified frequency range can be selectively damped in accordance with the present invention, the vibration absorber is well suited for use with various types of rackets with optimum damping effect.

We claim:

1. A vibration absorbing apparatus adapted to be mounted within the straight end section of a racket comprising a visco-elastic member including first and second substantially parallel elongated faces, elongated securing means including a first end and a second end, said first end of said elongated securing means being adapted to be substantially fixedly mounted with respect to said visco-elastic member and said straight end section of said racket and said second end of said elongated securing means being substantially freely movable in response to vibrations applied to said racket, said elongated securing means including first and second elongated leaf spring members mounted on said first and second elongated faces of said visco-elastic member, respectively, whereby said visco-elastic member is sandwiched therebetween, and mass means affixed to said second end of said elongated securing means whereby upon mounting of said vibration absorbing apparatus within said straight end section of said racket, vibrations applied to said racket are substantially dampened by said visco-elastic member and said movement of said second end of said elongated securing means.

2. A vibration absorbing racket including a racket head and a straight end section supporting said racket head, said vibration absorbing racket comprising a visco-elastic member including first and second substantially parallel elongated faces, mounting means for said visco-elastic member within said straight end section of said racket, elongated securing means mounting said visco-elastic member, said elongated securing means including a first end and a second end, said first end of said elongated securing means being fixedly mounted with respect to said visco-elastic member and said straight end section of said racket and said second end of said elongated securing means being substantially freely movable in response to vibrations applied to said racket head, said elongated securing means including first and second elongated leaf spring members mounted on said first and second elongated faces of said visco-elastic member, respectively, whereby said visco-elastic member is sandwiched therebetween, and mass means affixed to said second end of said elongated securing means whereby said vibrations applied to said racket head are substantially dampened by said visco-elastic member and said movement of said second end of said elongated securing means in response to said vibrations applied to said racket head.

3. The vibration absorbing racket of claim 2 wherein said mounting means is secured to the inner wall of said straight end section of said racket.

* * * * *